US006231807B1

(12) United States Patent
Berglund

(10) Patent No.: US 6,231,807 B1
(45) Date of Patent: May 15, 2001

(54) DISPERSION HARDENING ALLOY AND METHOD FOR THE PRODUCTION OF THE ALLOY

(75) Inventor: Roger Berglund, Västerås (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/244,627

(22) Filed: Feb. 4, 1999

(30) Foreign Application Priority Data

Feb. 4, 1998 (SE) ..... 9800324

(51) Int. Cl.[7] ..... C22C 38/06; C22C 38/18

(52) U.S. Cl. ..... 420/62; 420/63; 148/318; 148/230

(58) Field of Search ..... 420/62, 63; 148/318, 148/230

(56) References Cited

U.S. PATENT DOCUMENTS

| | | | |
|---|---|---|---|
| 3,847,682 | 11/1974 | Hook | 148/12.1 |
| 3,992,161 | 11/1976 | Cairns et al. | 29/182.5 |
| 5,073,409 | 12/1991 | Anderson et al. | 427/217 |
| 5,114,470 | 5/1992 | Biancaniello et al. | 75/338 |

FOREIGN PATENT DOCUMENTS

| | | |
|---|---|---|
| 2 128 639 | 6/1971 | (DE) . |
| 0 161 756 A1 | 11/1985 | (EP) . |
| 0 165 732 A1 | 12/1985 | (EP) . |
| 0 225 047 A2 | 6/1987 | (EP) . |
| 230 123 | 7/1987 | (EP) . |
| 0 258 969 B1 | 3/1988 | (EP) . |
| 0 363 047 B1 | 4/1990 | (EP) . |
| 2 048 955 | 12/1980 | (GB) . |
| 2156863 | 10/1985 | (GB) . |
| 2 183 676 | 6/1987 | (GB) . |
| WO96/33831 | 10/1996 | (WO) . |

OTHER PUBLICATIONS

G. William Goward, et al., "Diffusion Coatings", *ASM Handbook*, vol. 5, Surface Engineering, pp. 611–620 (1994).

*Primary Examiner*—Roy King
*Assistant Examiner*—Nicole Coy
(74) *Attorney, Agent, or Firm*—Burns, Doane, Swecker & Mathis, L.L.P.

(57) ABSTRACT

A dispersion hardened FeCrAl-alloy and method of its production which includes in one step, forming a nitride dispersion in a FeCr-alloy, whereby this nitride dispersion includes one or more of the basic elements hafnium, titanium and zirconium, and, in a later step aluminum is added to the nitrided FeCr-alloy. The unfavorable formation of aluminum nitrides has thereby been avoided by adding aluminum after the nitriding. A FeCrAl-alloy with high high temperature strength and high creep strength has thereby been achieved.

11 Claims, No Drawings

DISPERSION HARDENING ALLOY AND METHOD FOR THE PRODUCTION OF THE ALLOY

BACKGROUND OF THE INVENTION

In the description of the background which follows, reference is made to certain compositions, structures and methods, however, such references should not necessarily be construed as an admission that these compositions, structures and methods qualify as prior art under the applicable statutory provisions.

Ferritic materials of FeCrAl-type have good high temperature oxidation resistance properties but relatively low strength. It is known that high temperature strength and creep strength can be improved by preventing grain boundary slip through a combination of reduction of the grain boundary area and by adding material that prevents grain boundary slip and dislocation movements in the alloy.

Grain boundary slip is counteracted by a reduction in grain boundary area. One way of reducing grain boundary area is, of course, by increasing the grain size. Grain boundary slip can also be reduced by the introduction of stable particles, which counteract mobility of the grain boundaries. Such particles, which can be used in combination with reduced grain boundary area, have a size generally on the order of 50–1000 nm.

The high temperature strength of the alloy can also be improved by introducing a distribution of particles preventing dislocation movements. Particles used to this end should preferably have an average size of 10 nm or less, and be evenly distributed with an average distance of less than 200 nm. These particles must be extremely stable in relation to the metal matrix, in order not to be dissolved or coarsen with time. Suitable particle forming materials that counteract grain boundary slip and dislocation movements include stable nitrides of titanium, hafnium, zirconium and vanadium.

Consequently, it is known to nitride Fe and Ni based alloys containing stable nitride formers, such as Ti, and thereby create a dispersion of stable nitrides. Attempts have been made to nitride titanium containing FeCrAl-alloys in order to improve the high temperature and creep strength of these alloys. However, it has been established that the presence of Al, which is a fairly strong nitride former, results in a lowered solubility of nitrogen, which makes it difficult to transport nitrogen in the material. As a result, there is an inadequate amount of fine precipitation of titanium nitride. Furthermore, aluminum is bound in the form of aluminum nitride, which is harmful to the oxidation properties of the alloy. This aluminum nitride can be dissolved only at high temperatures thereby freeing up nitrogen for the formation of titanium nitride. However, titanium nitride formed in this manner becomes too coarse to effectively counteract dislocation movements. The presence of aluminum can further lead to precipitations of aluminum titanium nitride, which again is too coarse for the intended purposes.

In EP-A-225 047 a method to create a nitride dispersion by mechanically grinding powder containing a nitride former (preferably Ti) together with a nitrogen donor (preferably CrN and/or Cr2N) (so called MA-technique, where "MA" stands for Mechanical Alloying; see e.g., "Metals Handbook," 6th edition, volume 7, pp. 722–26). The grinding is carried out in a nitrogenous atmosphere. After grinding, the powder is heat treated in hydrogen gas to form titanium nitride and the nitrogen surplus is gassed off. The powder can then be consolidated by HIP'ping or extrusion. However, such alloys that do not contain aluminum have inferior oxidation properties at high temperatures when compared with FeCrAl-alloys.

In EP-A-256 555 an ODS-alloy (ODS: "Oxide Dispersion Strengthened") of FeCrAl-type is described. This alloy contains precipitations of a finely dispersed phase with a melting point of at least 1510° C. The alloy consists of 20–30% Cr; 5–8% Al; 0.2–10 volume-% refractory oxides, carbides, nitrides and borides; <5% Ti; <2% Zr, Hf, Ta or V; <6% Mo or W; <0.5% Si and Nb; <0.05% Ca, Y or rare earth metals; and <0.2% B. The alloy is made by a grinding method (MA-technique). It is said to be very resistant to oxidation and corrosion up to 1300° C. and to have good high temperature mechanical properties. However, the grinding process used to produce these alloys is very costly.

U.S. Pat. No. 3,992,161 describes FeCrAl-alloys with improved high temperature properties, whereby particles are ground into FeCrAl. The particles can include oxides, carbides, nitrides, borides or combinations thereof. Once again, the costly grinding process is utilized.

In the article of E. G. Wilson: "Development of powder routes for TiN dispersion strengthened stainless steels", Proceedings from the Conference on HNS 88 (High Nitrogen Steel 88), Lille, France, May 18–20, 1988, published by The Institute of Metals, England, an alternative method of achieving dispersion hardening is described, namely by precipitation of nitrides with high stability, for instance TiN. This method includes nitriding an alloy containing any element that forms stable nitrides. This nitriding is done in a fluidised bed and consolidation of the powder is accomplished by extrusion. The powder alloy is heated in a nitrogen-hydrogen gas mixture at 1150° C. during formation of a dispersion of TiN-particles having a size of 50–200 nm. Surplus nitrogen is gassed off at the same temperature. In order to achieve the desired effect, the formed TiN-particles should be on the order of 20–30 nm in size. A prerequisite for formation of these fine TiN-particles is a high nitrogen activity, which can be achieved by a short diffusion distance and a high nitrogen gas pressure. The author suggests introduction of chromium nitride as a nitrogen donor. A high dissociation pressure is achieved by heating the chromium nitride to 1150° C. However, these alloys contain no aluminum and therefore lack the appropriate corrosion properties. Furthermore the nitriding method is based on diffusion and is therefore inappropriate for thick walled sections since the ability of nitrogen to adequately penetrate deeply into the section is limited.

EP-A-161 756 relates to nitriding of a Ti-alloyed powder material in an ammonia/hydrogen gas mixture by formation of chromium nitrides in the form of a surface layer on the powder grains. The chromium nitrides can be dissolved at a higher temperature in an inert atmosphere, whereby nitrogen is set free, which then couples with titanium to form titanium nitride precipitations in the grains. Again there is no aluminum present which adversely affects corrosion properties.

EP-A-165 732 describes a method for making of titanium nitride dispersion hardened products. The nitriding is carried out on a porous powder body. Chromium and titanium containing iron or nickel base powder, which has gone through a soft sintering in hydrogen gas, is nitrided in a mixture of ammonia and hydrogen gas, so that chromium nitrides are formed on the free surfaces. Subsequently, a heat treatment in pure hydrogen gas at a higher temperature is carried out, whereby the chromium nitrides become disassociated, thereby freeing up nitrogen. Consequently, particles of titanium nitride are formed. The body is consolidated afterwards through extrusion, rolling or other methods. The disclosed alloy does not contain aluminum.

EP-A-363 047 describes the admixture of a nitrogen donor in the form of a less stable nitride, usually chromium nitride, in a powder containing a nitride former. Nitrogen is liberated from the donor by heating and can then react with the nitride former in the powder, so that fine nitrides are precipitated. Treatment of titanium containing FeCrAl-powder with this method results in the precipitation of aluminum nitride, which is difficult to dissolve, rather than a primarily titanium nitride containing powder. The aluminum nitride can be dissolved at high temperature and form titanium nitride, but as mentioned above, this leads to the formation of titanium nitride and to the precipitation of aluminum titanium nitride.

GB-A-2 156 863 relates to a titanium nitride dispersion hardened steel. This method describes a process to make a titanium nitride dispersion hardened powder-metallurgy alloy of stainless steel, or nickel-based alloy, containing titanium. The process includes heating of the alloy in ammonia to about 700° C., whereby the ammonia gas disassociates and a layer of chromium nitride is formed on the surface of the powder grains. The chromium nitride is dissociated in a subsequent step in a mixture of nitrogen gas and hydrogen gas after rapid heating to a temperature of 1000–1150° C., whereby titanium nitride is formed. This method results in great amounts of atomic nitrogen corresponding to a very high nitrogen activity level. The heat treatment continues after the formation of titanium nitrides as the composition of the gas simultaneously is changed to pure hydrogen gas for removal of surplus nitrogen. Since this method involves the treatment of FeCrAl-powder in a nitrogen-rich environment as described above, aluminum nitride is precipitated. As previously noted, this aluminum nitride compound is difficult to dissolve. While the compound can be dissolved at high temperature to form titanium nitride, the disadvantageous coarsening of the resulting titanium nitride, as well as the disadvantageous precipitation of aluminum titanium nitride results.

Further nitriding methods are described in EP-A-258 969, GB-A-2 048 955, U.S. Pat. No. 3,847,682, U.S. Pat. No. 5,073,409 and U.S. Pat. No. 5,114,470, and in ASM Handbook, volume 4, 1991 edition, pages 387–436.

When applying nitriding methods according to above on aluminum oxide forming high temperature alloys, nitrogen will preferably be bound as aluminum nitride. This leads to two drawbacks. First, that the ability of the alloy to form a protective aluminum oxide is limited. Second, the formed nitrides become too big and are not stable enough.

Therefore, it would be advantageous to be able to form an alloy with good oxidation resistance, as well as good high temperature strength and creep resistance, in a cost effective manner.

OBJECTS AND SUMMARY OF THE INVENTION

An object of the present invention is to provide a FeCrAl-alloy with high temperature strength and high creep strength.

Another object of the present invention is to provide a FeCrAl-alloy in which the existence of aluminum nitrides, and also other mixed nitrides containing aluminum, is reduced to a minimum.

These and other objects can be attained by first making a nitride dispersion in a FeCr-alloy, and then subsequently introducing aluminum into the alloy. The alloy produced in this manner has a fine dispersion of nitrides and strongly resists grain boundary slip and dislocation movements under high temperatures.

DETAILED DESCRIPTION OF PREFERRED EMBODIMENTS OF THE INVENTION

An appropriate starting material for the nitriding includes 10–40 weight-% chromium; not more than 5 weight-% each of silicon, manganese, cobalt, nickel, molybdenum and tungsten; less than 2 weight-% total of carbon, yttrium and rare earth metals; less than 5 weight-% total of any of the basic elements hafnium, titanium, vanadium and zirconium; not more than 3 weight-% aluminum; and the rest iron with natural occurring impurities. Preferably, the aluminum content is zero at this starting stage. After the precipitation of stable nitrides, aluminum is dissolved into the primarily ferritic matrix in an amount that provides the material with good oxidation resistance at high temperature. This aluminum content is preferably between 2 and 10 weight-%.

The starting material can be in the form of a powder, a thin strip, a wire of small dimensions or a thin walled tube. Any of the mentioned basic elements Hf, Ti, V and Zr function as nitride formers. Preferably Ti is used. In order to achieve the desired effect, the starting material should contain at least 0.5 weight-% total amount of one or more of the mentioned basic elements Hf, Ti, Y, V and Zr.

A high processing temperature promotes the formation of titanium nitride by increasing the diffusion speed, while a low processing temperature is desirable in order to obtain a fine dispersion of titanium nitrides by the formation of many nucleation sites.

Nitriding can be accomplished by any of the methods described in the above cited state of the art documents, which methods are hereby incorporated by reference.

According to one appropriate method of the present invention, FeCrTi-powder is mixed with chromium nitride powder, the powder mixture is placed in a container, which is evacuated and closed. Subsequently, the mixture is heated to 900–1000° C., whereby the chromium nitride is separated into chromium and nitrogen, which are dissolved in the FeCrTi-material. Nitrogen and titanium thereby form titanium nitride.

According to another method, the first step is to nitride the surface of the alloy in a mixture of ammonia and hydrogen gas at a temperature above approximately 550° C. Nitrogen then exists as free nitrogen and in the form of chromium nitrides. In a subsequent step, titanium nitrides are formed after a rapid heating to a temperature of between 1000 and 1150° C. in an inert atmosphere. After the formation of titanium nitrides, the heat treatment continues in order to remove surplus nitrogen.

According to another preferred process, nitriding occurs in an atmosphere with high nitrogen gas pressure. Pressure and temperature are adapted to achieve a superficial or surface nitriding, similar to that obtained by dissociation of ammonia. Precipitation of titanium nitrides occurs in the same manner as described above.

Other examples of possible nitriding methods include salt baths, plasma and fluidised beds. The present invention is not limited to powder metallurgy methods.

The nitriding of the FeCr-powder containing a nitride former according to above should not take place at too high a temperature, because the powder should remain free flowing in order to allow the admixture of aluminum. At 800° C. problems with agglomeration caused by sintering between clean powder surfaces start. Moreover, the nitride precipitations become finer if they form at lower temperatures. However, the benefits of lower processing temperatures are somewhat mitigated by slower reactions or kinetics. Thus, in order to achieve fine nitrides in a reasonable time, relatively low temperature and high nitrogen activity is required. Suitable temperatures are between 500 and 800° C., preferably between 550 and 750° C.

After nitriding according to any of the methods described above, the alloy contains nitrides (such as titanium nitride) in an essentially ferritic matrix of chromium and iron. When the surplus of nitrogen in the alloy has been removed, aluminum is added. This aluminum can either be in essentially pure form, or may optionally contain small amounts of reactive elements intended to improve the properties of the aluminum oxide in the final product. Such additives may be one or more of the elements yttrium, zirconium, hafnium, titanium, niobium and/or tantalum, and one or more of the rare earth metals. The total amount of these additives should not be above 5 weight-%, preferably 3 weight-%, and in particular, not above 1.5 weight-%.

Subsequent to the nitriding step, and possibly other intervening processing steps, the nitrided FeCr-product is subsequently alloyed with aluminum. This aluminization can be made in a number of ways, some of which are described below.

Aluminum metal is atomized with a suitable inert gas such as argon, and nitrided FeCr-powder is added to the atomization gas. A mixture of aluminum powder and nitrided FeCr-powder is obtained from the above process. The amount of added FeCr-powder used is chosen in relation to the aluminum flow, such that the desired aluminum content in the mixture can be obtained. The mixed powder can then be encapsulated and compacted according to known methods.

According to a known method, the powder mixture is filled into a sheet metal capsule, which is evacuated and closed. A capsule filled with a mixture consisting of >2 volume-% aluminum powder, preferably between 8 and 18 volume-%, and the rest nitrided FeCr-powder, is cold isostatic pressed to a relatively high density. The capsule is then heated to a temperature near the melting point of aluminum. The solid or liquid Al-phase then goes successively into solid solution with the ferritic phase in the nitrided FeCr-material. The temperature is regulated to avoid the formation of embrittling intermetallic aluminide phases.

An evacuated capsule filled with the powder mixture can also be hot isostatic pressed. The pressing is preferably done at a temperature near or just above the melting point of aluminum. Aluminum can thereby easily fill out the voids between the harder, higher melting FeCr-grains. The pressing goes on until the aluminum has been dissolved into the FeCr-ferritic phase.

Compacted capsules according to above can later be hot formed into other shapes, such as a rod, wire, tube, strip or any other suitable shape. Suitable hot forming techniques include extrusion, forging, and rolling.

A nitrided FeCr-powder can also be mixed mechanically with the aluminum powder in proportions such that a desired final aluminum content is obtained. Subsequently, the mixed powder might be sent to encapsulation and compaction according to the above.

Handling the powder mixtures described above creates a risk of demixing of the powder components. In order to counteract this, the mixture can be ground.

When mixing, milling and after treating the powder, handling should take place in an inert atmosphere in order to avoid reaction between the powder and oxygen.

It is also possible to consolidate the powder mixture described by a technique such as metal injection molding (i.e., so-called "MIM" technique), and subsequently homogenize the material with a sintering operation.

According to another aspect of the present invention, a porous sintered body of nitrided FeCr-powder can be infiltrated with melted aluminum. To achieve better penetration the FeCr-body, the body can be preheated and the infiltration can be made in a pressurized apparatus.

The methods for alloying with aluminum described above relate to products made by powder metallurgy techniques.

However, other techniques can be utilized. For instance, thin walled tubes, thin strips and thin wires of non powder metallurgy origin can be formed from the FeCr alloy. For example, a thin strip of FeCr-alloy including a nitride dispersion according to the above is covered with aluminum by a suitable compound-technique such as pâvalsning, (see, e.g.—U.S. Pat. No. 5,366,139) dipping in aluminum baths, or by methods described in ASM Handbook, vol. 5, 1991, pages 611–620. Subsequently, the aluminum is dissolved into the ferritic phase of the FeCr-strip by means of a suitable heat treatment.

In a similar manner, it is also possible to produce nitride dispersion hardened FeCrAl-alloy in the form of wire or a product shaped from a thin wire, for example, nets or helices. The wire product is nitrided, then subsequently covered with aluminum, and heat treated.

Further, the alloying with aluminum can be done in solid phase by a so called cladding-technique, see, e.g., U.S. Pat. No. 5,366,139. A ferritic stainless FeCr-strip is made by melting, casting and rolling and aluminum is cold welded onto both sides thereof. Heat treatment is applied to dissolve the Al into the FeCr-strip and a FeCrAl-composition is obtained. The advantage of this technique is that many of the difficulties with conventional production of FeCrAl are avoided i.e., FeCrAl-melts require more expensive linings in ovens and ladles, FeCrAl-alloys are more brittle, therefore they are more difficult to continuously cast, pose an increased risk of crack formation during cold rolling, and result in fragile castings and blanks that must be handled with great care).

Dipping of thin walled details can also be done according to the method of U.S. Pat. No. 3,907,611, by which a great improvement in resistance to high temperature corrosion and oxidation of iron base alloys is achieved. The method includes aluminisation by dipping in melted aluminum, accompanied by two heat treatments. The first heat treatment is carried out in order to shape an intermetallic surface layer and the second in order to achieve good adhesion of the layer. U.S. Pat. No. 4,079,157 also describes a method for the production of shape-stable material. Austenitic steel is aluminized by dipping in an AlSi-bath. The silicon diminishes the tendency of aluminum to diffuse into the alloy, and it stays near the surface instead.

The principles, preferred embodiments and modes of operation of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes, and equivalents which fall within the spirit and scope of the invention be embraced thereby.

What is claimed is:

1. A dispersion hardened FeCrAl-alloy having a microstructure comprising a solid solution of aluminum in an essentially ferritic matrix of chromium and iron, the alloy having a composition comprising 10–40 weight-% chromium, 2–10 weight-% aluminum, not more than 5 weight-% each of silicon, manganese, cobalt, nickel, molybdenum and tungsten, less than 2 weight-% total of carbon, yttrium and rare earth metals, and less than 5 weight-% total of any of the nitrides of the basic elements hafnium, titanium, vanadium and zirconium, and the rest iron with naturally occurring impurities.

2. The alloy according to claim 1, wherein the nitrides exist as distributed, dispersed particles having a size within the range 1–1000 nm.

3. The alloy according to claim 2, wherein the amount of dispersed phase constitutes 1–10 volume—%.

4. The alloy according to claim 1, further comprising oxides, carbides, or a combination of oxides and carbides of hafnium, titanium, vanadium and zirconium.

5. The alloy according to claim 1, wherein the alloy exists in the form of strip, tube, rod, wire and/or net.

6. The alloy of claim 1, wherein the alloy is formed by providing an initial composition comprising no aluminum, precipitating stable nitrides in the initial composition, and subsequently dissolving aluminum into the alloy to render a composition having said microstructure and an aluminum content of 2–10% by weight.

7. The alloy according to claim 1, wherein said particles have a size of 2–300 nm.

8. The alloy according to claim 1, wherein said particles have a size of 2–50 nm.

9. The alloy of claim 1, wherein the composition comprises at least 0.5 weight % of the total amount of one or more of hafnium, titanium, vandium, and zirconium.

10. The alloy of claim 6, wherein the subsequently added aluminum is pure aluminum.

11. The alloy of claim 6, wherein the subsequently added aluminum contains reactive elements that improve the properties of aluminum oxide formed in the alloy.

* * * * *